US006897746B2

(12) United States Patent
Thomson et al.

(10) Patent No.: US 6,897,746 B2
(45) Date of Patent: May 24, 2005

(54) PHASE STABLE WAVEGUIDE ASSEMBLY

(75) Inventors: R. Glenn Thomson, Waterloo (CA); Ming Yu, Waterloo (CA)

(73) Assignee: Com Dev Ltd., Cambridge (CA)

( * ) Notice: Subject to any disclaimer, the term of this patent is extended or adjusted under 35 U.S.C. 154(b) by 105 days.

(21) Appl. No.: 10/465,226

(22) Filed: Jun. 20, 2003

(65) Prior Publication Data

US 2003/0234707 A1 Dec. 25, 2003

Related U.S. Application Data

(60) Provisional application No. 60/389,931, filed on Jun. 20, 2002.

(51) Int. Cl.[7] ..... H01P 1/30
(52) U.S. Cl. ..... 333/229; 333/234
(58) Field of Search ..... 333/229, 234, 333/135

(56) References Cited

U.S. PATENT DOCUMENTS

| | | | | |
|---|---|---|---|---|
| 3,771,074 A | | 11/1973 | Fletcher et al. | |
| 4,342,474 A | | 8/1982 | Sewell et al. | |
| 5,428,323 A | | 6/1995 | Geissler et al. | |
| 5,867,077 A | * | 2/1999 | Lundquist | 333/208 |
| 6,002,310 A | | 12/1999 | Kich et al. | |
| 6,433,656 B1 | * | 8/2002 | Wolk et al. | 333/248 |

OTHER PUBLICATIONS

D. Eatly, "The Mechanical Strength and Stiffness of Pressurized Microwave Devices", The Marconi Review, First Quarter, pp. 44 to 61. 1975.

* cited by examiner

*Primary Examiner*—James H. Cho
(74) *Attorney, Agent, or Firm*—Bereskin & Parr; Isis E. Caulder

(57) ABSTRACT

A waveguide assembly for operation over a range of temperatures includes a waveguide body and a plurality of restraining strips coupled to the waveguide body. The waveguide body includes a pre-curved narrow sidewall of material having a first coefficient of thermal expansion (CTE). The restraining strips are coupled to the waveguide body at first and second lateral points on either side of the pre-curved narrow sidewall laterally and are spaced apart along the length of the waveguide body, and are made from a material having a second CTE much less than the first CTE. Thus, when the temperature of the waveguide assembly changes, the restraining strips maintain a substantially constant lateral distance between said first and second lateral points over the range of temperatures such that as the length of the waveguide varies with temperature, the curvature of the pre-curved narrow sidewall also changes, causing the effective large dimension of the waveguide assembly to vary such that the combination of said changes results in a constant phase length for said waveguide body.

7 Claims, 7 Drawing Sheets

PHASE STABLE WAVEGUIDE ASSEMBLY

This application claims the benefit under 35 U.S.C. 119(e) of U.S. Provisional Application No. 60/389,931, filed Jun. 20, 2002.

FIELD OF THE INVENTION

This invention relates to a waveguide assembly and more particularly to a waveguide assembly that uses thermally compensating structures to compensate for changes in expansion/contraction of a waveguide volume due to changes in environmental temperature.

BACKGROUND OF THE INVENTION

Typically, multiplexer assemblies that are used in aerospace applications are designed to have insignificant dimensional changes as a result of changes in temperature so that the spacing between filters does not appreciably change with changes in temperature. As a result, aerospace waveguide assemblies are typically manufactured from low expansion materials (i.e. materials that have low coefficients of thermal expansion (CTE)) such as INVAR™ or titanium. However, it is often necessary to physically attach waveguides to a panel on the body of a spacecraft which is generally manufactured from lightweight materials with relatively high coefficients of thermal expansion (CTE), such as aluminum. Accordingly, when low CTE waveguide assemblies are coupled to high CTE spacecraft bodies, substantial physical strain between the structures results with a corresponding increase in faulty mechanical operation.

Accordingly, it is desirable to provide a waveguide assembly for space application that will experience changes in dimension (i.e. length) that correspond with the dimensional changes of the spacecraft panel. Temperature compensating waveguide assemblies use a variety of mechanical deformation techniques to compensate for temperature-dependent volume changes in a waveguide that cause shifts in the frequency profile of a waveguide. Prior art approaches utilize various mechanical arrangements of materials having different coefficients of thermal expansion to cause deformation of waveguide walls in response to changes in temperature. However, these assemblies suffer from practical disadvantages that detrimentally affect their suitability for space application.

For example, U.S. Pat. No. 5,428,323 to Geissler et al. discloses a waveguide assembly that includes a waveguide having walls defining a cavity. A frame surrounds the walls of the waveguide having a coefficient of thermal expansion less than that of the waveguide. First and second connecting spacers are attached in between the frame and the waveguide and serve to transmit heat expansion related forces to the waveguide walls that causes deformation of the waveguide walls. While the sectional frame allows expansion along its length, the structure requires an external frame and accordingly the overall assembly is cumbersome and is not well suited for space application.

U.S. Pat. No. 6,002,310 to Kich et al. discloses a resonator cavity end wall assembly which comprises a waveguide body and two end wall assemblies, where each end wall assembly includes a bowed aluminum plate and an INVAR™ disk, attached to one another at the periphery thereof. The INVAR™ disk includes a relatively thick outer annular portion and a relatively thin inner circular portion. The bowed aluminum plate bows in response to increased temperature, thereby counteracting the expansion of the waveguide body. When temperature increases, 'oil can' bowing of the aluminum plate within the end wall assemblies causes the cavity diameter to increase and the axial length to be reduced. Accordingly, this assembly is not suitable for aerospace application where in the case of increased temperature, the axial length of a waveguide should match an increase in axial length of a spacecraft panel.

SUMMARY OF THE INVENTION

The invention provides in one aspect, a waveguide assembly for operation over a range of temperatures, said waveguide assembly comprising:

(a) a waveguide body having an effective large dimension and a length, said waveguide body including at least one pre-curved narrow wall made from material having a first coefficient of thermal expansion;

(b) a plurality of restraining strips extending across said pre-curved narrow wall and coupled to the waveguide body on either side of said pre-curved narrow sidewall at first and second lateral points, said restraining strips being spaced from each other and being provided along the length of said waveguide body and being made from a material having a second coefficient of thermal expansion substantially less than the first coefficient of thermal expansion; and (c) said plurality of restraining strips being used to maintain a substantially constant lateral distance between said first and second lateral points over the range of temperatures such that as the length of the waveguide varies with temperature, the degree of curvature of said at least one pre-curved narrow sidewall varies to cause the effective large dimension of the waveguide assembly to change such that the combination of said changes results in a constant phase length for said waveguide body as said waveguide body expands or contracts with temperature.

Further aspects and advantages of the invention will appear from the following description taken together with the accompanying drawings.

DETAILED DESCRIPTION OF THE INVENTION

Figure 1:
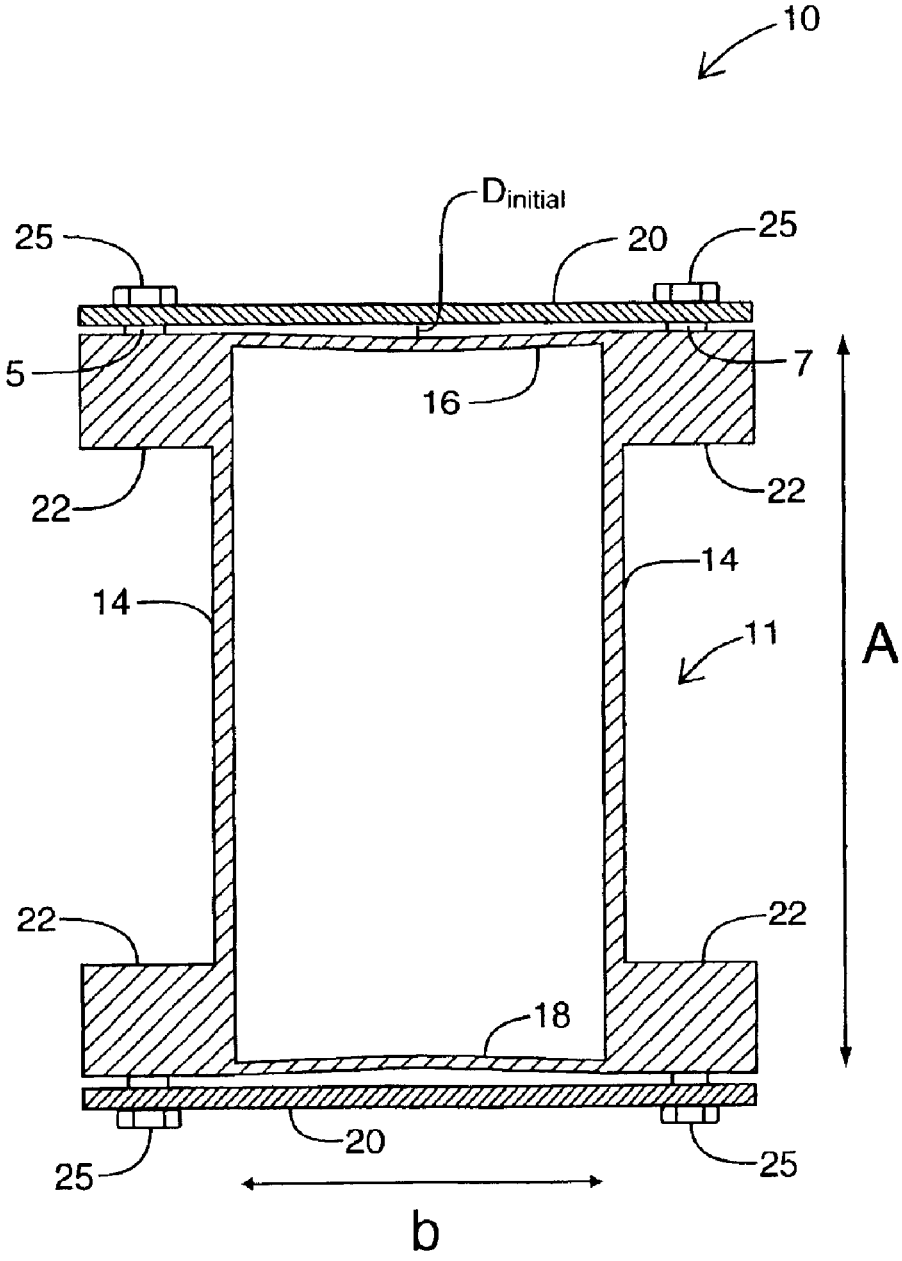
FIG. 1 is a lateral cross-sectional view of an example of a waveguide assembly in accordance with the present invention.

FIG. 1 illustrates a preferred embodiment of a waveguide assembly 10 built in accordance with the present invention.

Specifically, waveguide assembly 10 consists of a manifold waveguide 11 comprising two long walls 14 and two pre-curved narrow walls 16, 18, and four flanges 22, all of which extend the length of manifold waveguide 11. Waveguide assembly 10 also includes a plurality of restraining strips 20. Restraining strips 20 extend across and straddle pre-curved narrow walls 16 and 18, and are located at spaced apart positions along the length of manifold waveguide 11 (see also FIGS. 2 and 3, discussed below). Long walls 14 together with narrow walls 16 and 18 form a substantially rectangular cavity that is allowed to change its longitudinal length as a result of changes in temperature while the specific structure of waveguide assembly 10 results in cross-sectional dimensional changes which are designed to compensate for changes in longitudinal length, as will be described.

Long walls 14 are two walls that extend along the length of waveguide assembly 10 and have a large (or broad) dimension "A" as shown. The cross-section of manifold waveguide 11 also has a smaller dimension, namely "b", as shown.

Pre-curved narrow walls 16 and 18 are pre-curved in lateral cross-section as shown in FIG. 1 such that an original curvature at ambient temperature is present with an associated initial deflection distance $D_{initial}$, as shown. Pre-curved narrow walls 16 and 18 can be manufactured from a variety of metallic materials (e.g. aluminum or magnesium) as well as composite materials (e.g. T300 or any low modulus, relatively high expansion composite). It should be understood that while it is preferable for waveguide assembly 10 to contain two pre-curved walls 16, 18, it is also possible for waveguide assembly 10 to contain just one pre-curved wall 16 (not shown).

Restraining strips 20 are positioned and secured laterally on either side of the two pre-curved narrow walls 16, 18 to manifold flanges 22 using fasteners 25 (e.g. nuts and bolts) at first and second lateral points 5 and 7 as shown. However, it should be understood that attachment of restraining strips 20 to the manifold flanges 22 of manifold waveguide 11 could also be accomplished using various other conventionally known mechanisms, such as bonding, soldering, and welding techniques. Bolted joints are preferred for applications where restraining strips 20 may be selected during assembly of waveguide assembly 10 to fine tune the waveguide compensation.

Restraining strips 20 can be manufactured from a variety of metallic materials (e.g. iron or nickel alloy) as well as composite materials (e.g. P100 or any similar high modulus, low expansion composite) and must have a substantially lower coefficient of thermal expansion (CTE) than that of pre-curved narrow walls 16 and 18. Accordingly, as discussed above, pre-curved narrow walls 16 and 18 can be made of a variety of low density, high expansion alloys (e.g. magnesium or aluminum), while retaining strips 20 can be made from a various types of iron/nickel alloys (e.g. INVAR™, KOVAR™, and other numerically known alloys). Alternatively, carefully selected combinations can also be made of various composites. It is contemplated that the coefficient of thermal expansion of iron and nickel alloys allow for 'tunability' of the amount of compensation provided by waveguide assembly 10.

Figure 2:
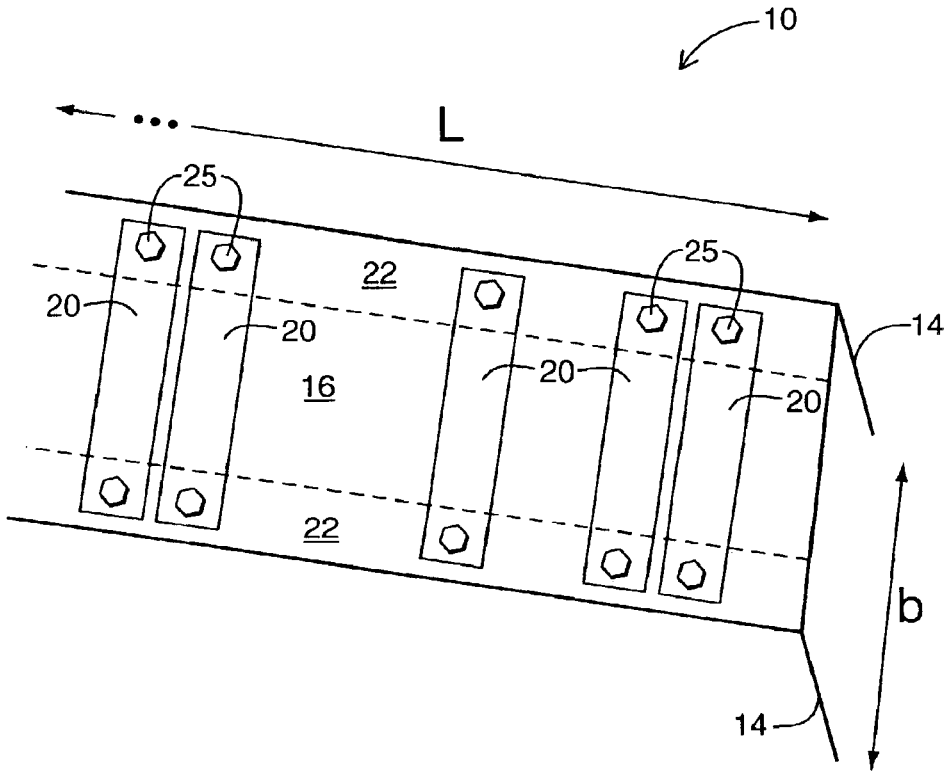
FIG. 2 is a top perspective view of the waveguide assembly of FIG. 1.
Figure 3:
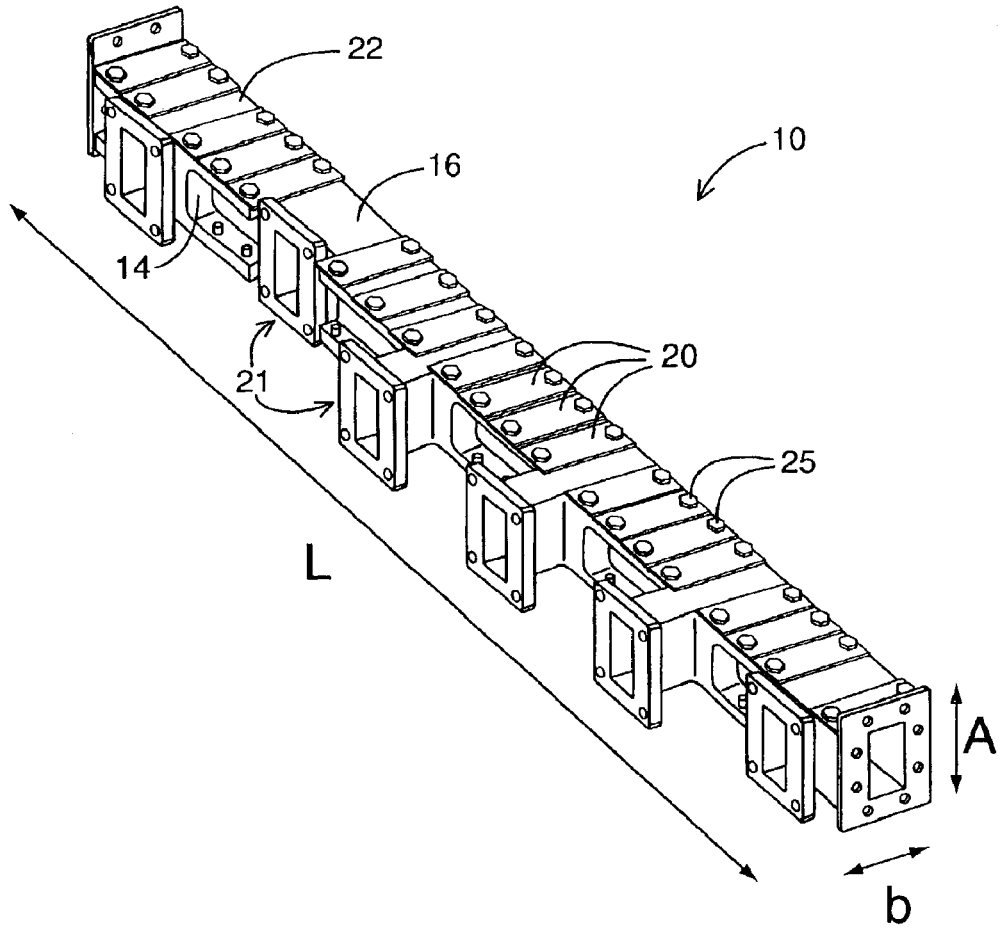
FIG. 3 is a side perspective view of the waveguide assembly of FIG. 1.

FIGS. 2 and 3 illustrate top and side perspective views, respectively, of waveguide assembly 10. These figures illustrate how restraining strips 20 are positioned in spaced-apart fashion laterally across the longitudinal length "L" of manifold waveguide 11 on the outer sides of pre-curved narrow walls 16, 18. Specifically, restraining strips 20 are secured by metallic screws 25 as shown at various points along the length of manifold waveguide 11. As can be seen, restraining strips 20 are located at certain positions along the length of manifold waveguide 11. Specifically, restraining strips 20 are located closely enough together to provide an essentially continuous even deflection of pre-curved narrow walls 16, 18. The spacing between restraining strips 20 may be slightly irregular to allow intersecting waveguides to join on a manifold. Also, the spacing will depend on the material thicknesses and relative stiffnesses of long walls 14 and pre-curved narrow walls 16 and 18.

Restraining strips 20 are arranged so that expansion or contraction of the cross-section of manifold waveguide 11 is restrained in the lateral direction (i.e. the smaller dimension "b" of the waveguide), yet the waveguide 11 is free to expand or contract along its length "L" due to temperature changes (FIGS. 2 and 3). It should be understood that if a restraining plate (i.e. a planar sheet that extends along the outer surface of pre-curved narrow wall 16 or 18) were used instead of separate restraining strips 20, that waveguide 11 would not be able to expand in the longitudinal direction (i.e. length "L" would remain substantially constant). Accordingly, by providing gaps between restraining strips 20 as shown in FIG. 3, it is possible for the lengthwise expansion of waveguide 11 to occur. The material utilized within manifold waveguide 11 is preferably chosen to match the coefficient of thermal expansion of the surface (i.e. spacecraft panel) on which it is mounted. Accordingly, waveguide assembly 10 can be mounted on a spacecraft panel or any other structure such that the coupled combination may remain unstressed by relative changes in length due to thermal expansion.

Finally, as shown in FIG. 3, manifold waveguide 11 can be used in association with a plurality of filters (not shown) which would be coupled to manifold waveguide 11 through filter stubs 21. As conventionally known, the number of wavelengths that exist between the filters (which includes the length of the filter stubs) affect the operation of the filters. Accordingly, it is desirable to maintain the phase length between filters at a constant value to ensure proper multiplexer characteristics through elevations and reductions of temperature.

Figure 4A:
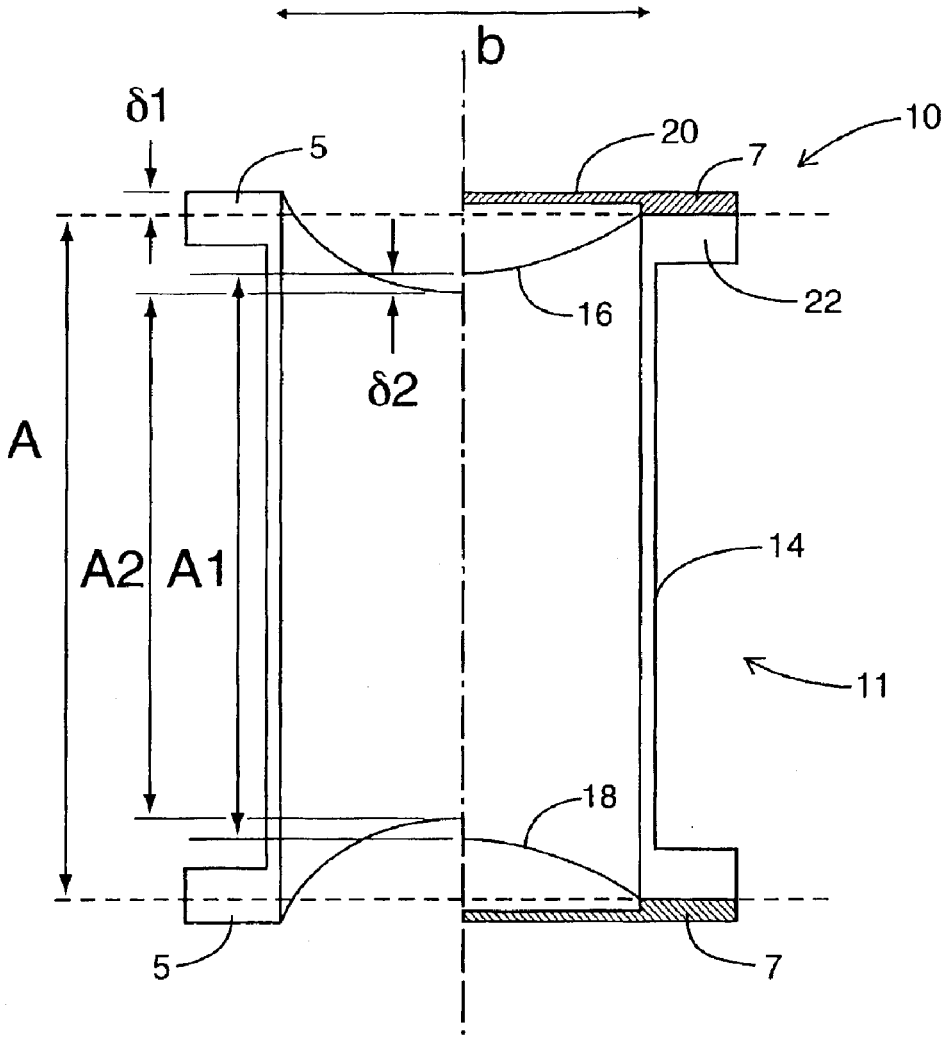
FIG. 4A is a lateral cross-sectional view of the waveguide assembly of FIG. 1 showing the cross-section of the waveguide at ambient temperature and at an elevated temperature.
Figure 4B:
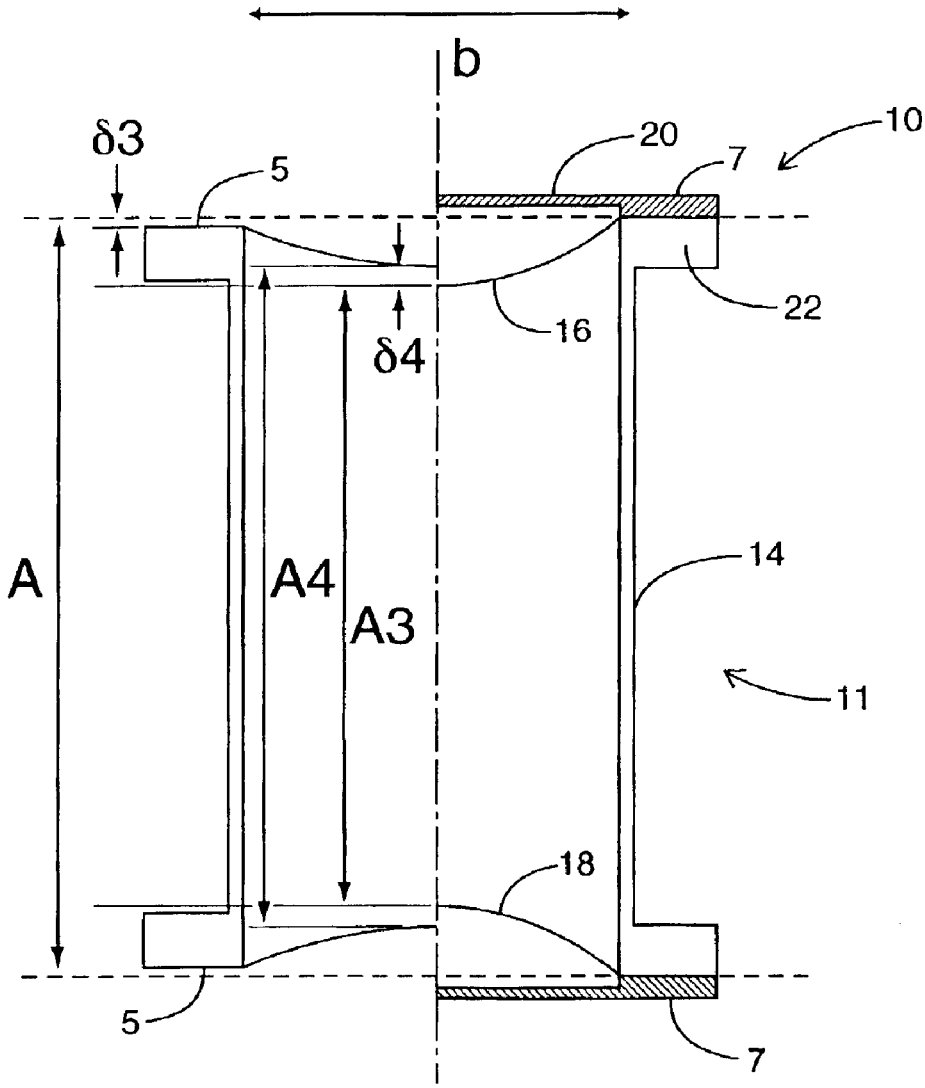
FIG. 4B is a lateral cross-sectional view of the waveguide assembly of FIG. 1 showing the cross-section of the waveguide at ambient temperature and at an reduced temperature.

FIGS. 4A and 4B illustrate how pre-curved narrow walls 16 and 18 and long walls 14 of waveguide assembly 10 change configuration at elevated and reduced temperatures.

Specifically, FIG. 4A illustrates the configuration of waveguide assembly 10 at ambient temperature (right hand side of FIG. 4A) and at elevated temperature (left hand side of FIG. 4A). At ambient temperature, the longitudinal length "L" of waveguide 11 is at an initial value $L_{initial}$, the lateral dimension of long walls 14 is "A" and the bulge-to-bulge dimension between narrow walls 16 and 18 is A1.

At elevated temperature, the longitudinal length "L" of waveguide 11 will increase to $L_{expand}$ according to its coefficient of thermal expansion in the presence of elevated temperature. That is, manifold waveguide 11 will expand in the direction transverse to the plane of the cross-section of waveguide assembly 10 shown in FIG. 4A simply due to thermal expansion. Also, at elevated temperature, long walls 14 expand freely in each direction by δ1 according to the material's thermal expansion coefficient (and thus the lateral dimension of the long walls 14 increases from A to A+2 (δ1)).

Pre-curved narrow walls 16 and 18 also expand but are restrained by restraining strips 20 which are coupled to manifold waveguide 11 on either side of pre-curved narrow walls 16 and 18 at first and second lateral points 5 and 7. Since restraining strips 20 have a lower coefficient of thermal expansion (CTE) than that of narrow walls 16 and 18 and long walls 14 (by a factor of as much as ten), first and second lateral points 5 and 7 will remain substantially in place during the elevation of temperature. The edge portions of pre-curved narrow walls 16 and 18 will remain substantially in place (at lateral points 5 and 7) due to the relatively small expansion of restraining strips 20. However, the middle portions of narrow walls 16 and 18 will be forced to expand inwards due to their pre-existing curvature, resulting in an increased degree of "curvature" with an increased deflection. Accordingly, when subjected to an elevated temperature, pre-curved narrow walls 16 and 18 of manifold waveguide 11 will expand inwards. Pre-curved narrow walls 16 and 18 flex into the waveguide by δ2 resulting in a decrease in bulge-to-bulge dimension (i.e. from A1 to A2 (where A2=A1−2(δ2)), as shown in FIG. 4A. It should also be understood that in response to elevated temperature, the curved section of pre-curved narrow walls 16 and 18 will expand and flex in the longitudinal direction at a greater rate than is the case for long walls 14.

FIG. 4B illustrates the configuration of waveguide assembly 10 at ambient temperature (right hand side of FIG. 4B) and at reduced temperature (left hand side of FIG. 4B). At ambient temperature, the longitudinal length "L" of waveguide 11 is at an initial value $L_{initial}$, the lateral dimension of long walls 14 is "A" and the bulge-to-bulge dimension between narrow walls 16 and 18 is A3.

At reduced temperature, the longitudinal length "L" of waveguide 11 will decrease to $L_{contract}$ according to its coefficient of thermal expansion in the presence of reduced temperature. That is, manifold waveguide 11 will contract in the direction transverse to the plane of the cross-section of waveguide assembly 10 shown in FIG. 4B simply due to thermal contraction. Also, at reduced temperature, long walls 14 contract in each direction by δ3 according to the material's thermal expansion coefficient (and thus the lateral dimension of the long walls 14 decreases from A to A−2 (δ3)).

Pre-curved narrow walls 16 and 18 also contract but are restrained by restraining strips 20 which are coupled to manifold waveguide 11 on either side of pre-curved narrow walls 16 and 18 at first and second lateral points 5 and 7. Since restraining strips 20 have a lower coefficient of thermal expansion (CTE) than that of narrow walls 16 and 18 and long walls 14 (by a factor of as much as ten), first and second lateral points 5 and 7 will remain substantially in place during the reduction of temperature. The edge portions of pre-curved narrow walls 16 and 18 will remain substantially in place (at lateral points 5 and 7) due to the relatively small contraction of restraining strips 20. However, the middle portions of narrow walls 16 and 18 will be forced to contract outwards due to their pre-existing curvature, resulting in a decreased degree of "curvature" with an decreased deflection. Accordingly, when subjected to a reduced temperature pre-curved narrow walls 16 and 18 of manifold waveguide 11 will contract outwards. Pre-curved narrow walls 16 and 18 flex out from the waveguide by δ4 as shown in FIG. 4B and result in an increase of bulge-to-bulge dimension (i.e. from A3 to A4 (where A4=A3+2(δ4)). It should also be understood that in response to reduced temperature, the curved section of pre-curved narrow walls 16 and 18 will contract in the longitudinal direction at a greater rate than is the case for long walls 14.

As a result of the geometrical dimensional changes that occur as a result of changes in temperature within waveguide assembly 10, certain wavelength characteristics of waveguide 11 will also change, as will be described. For a typical rectangular waveguide, the "guided wavelength" is generally defined as the distance between two equal phase planes along a waveguide. The guided wavelength of a waveguide is governed by its cross-section (and principally the effective large dimension or the lateral dimension of the long (or broad) wall for a conventional rectangular waveguide). The "phase length" of a waveguide is generally defined as being the number of wavelengths that can fit within the length of the waveguide and is generally governed by the length of the waveguide (i.e. "L" in the case of waveguide 11. In order for the number of wavelengths within a section of waveguide 11 (i.e. the "phase length") to remain constant in the face of changes in waveguide length "L" due to thermal expansion, the cross-section of waveguide 11 must change in a compensatory manner (i.e. to vary the guided wavelength appropriately so that the number of wavelengths remains constant).

For an electromagnetic wave propagating in a rectangular waveguide, it is conventionally known that all the electrical and magnetic field components are multiplied by the exponential function:

$$e^{-j\beta z} \tag{1}$$

where β is the propagation constant and z is the distance in the direction of propagation. For a waveguide of length L (where z=L) the phase length of a waveguide for a wave propagating from one end to the other is βL. Therefore the phase length of the wave can be controlled by changing either L or β. As is also conventionally known, the propagation constant β is a function of the operating frequency and the cross section dimensions of the waveguide. For TE10 mode (the dominant mode), the propagation constant β is:

$$\beta=\sqrt{k^2-(\pi/a)^2} \tag{2}$$

where a is the effective large dimension of the waveguide and k is a function of the frequency (which is considered constant for the purposes of the present invention). Therefore, the propagation constant β can be increased by increasing the effective large dimension a. The guided wavelength $\lambda_g$ (where g stands for "guided") is given by:

$$\lambda_g = \frac{2\pi}{\beta} \tag{3}$$

As is conventionally known, the electromagnetic behaviour of a conventional rectangular waveguide is strongly dependent on the value of the effective lateral dimension of long (or broad) walls. For example, for a rectangular waveguide commonly operated in TE10 mode, the lateral dimension of the narrow walls 16 and 18 has negligible effect on phase change.

Referring back to FIG. 4A, the right side of the figure shows the lateral cross-section of manifold waveguide 11 at an ambient temperature and the left side shows the lateral cross-section at an elevated temperature. In the present invention, the effective lateral dimension of the long walls 14 is an intermediate value between the initial lateral dimension of long wall 14 (i.e. "A") and the ambient bulge-to-bulge dimension (i.e. "A1"). The effective large dimension of waveguide 11 at an elevated temperature is an intermediate value between the lateral dimension of the long wall at the elevated temperature (i.e. "A+2(δ1)") and the elevated temperature bulge-to-bulge dimension (i.e. "A2" (where A2=A1−2(δ2)).

By careful design and selection of materials of waveguide 11, the lateral dimension δ2 that results from increased curvature of pre-curved walls 16 and 18 can be made to be greater than the lateral dimension δ1 that results from the simple increase in the dimension of long walls 14 in the face of a temperature increase. As a result, as temperature increases, the effective large dimension of manifold waveguide 11 is overall decreased due to the structural and material characteristics of waveguide assembly 10. It has been determined that there is no closed-form solution to determine the value for the effective large dimension of manifold waveguide 11, and that this value must be determined for each individual case (e.g. through computer simulation).

Referring to FIG. 4B, the right side of the figure shows the lateral cross-section of manifold waveguide 11 at an ambient temperature and the left side shows the lateral cross-section at a reduced temperature. In the present invention, the effective lateral dimension of the long walls 14 is an intermediate value between the initial lateral dimension of long wall 14 (i.e. "A") and the ambient bulge-to-bulge dimension (i.e. "A3"). The effective large dimension of waveguide 11 at an reduced temperature is an intermediate value between the lateral dimension of the long wall at the reduced temperature (i.e. "A+2(δ3)") and the reduced temperature bulge-to-bulge dimension (i.e. "A4" (where A4=A3+2(δ4)).

By careful design and selection of materials of waveguide 11, the lateral dimension δ4 that results from decreased curvature of pre-curved walls 16 and 18 can be made to be greater than the lateral dimension δ3 that results from the simple decrease in the dimension of long walls 14 in the face of a temperature decrease. As a result, as temperature decreases, the effective large dimension of manifold waveguide 11 is overall increased due to the structural and material characteristics of waveguide assembly 10.

As can be seen from equation (3), the guided wavelength for a particular waveguide increases as β gets smaller (i.e. and correspondingly as the effective large dimension "a" of the waveguide increases). Accordingly, when the length "L" of waveguide 11 increases due to elevated temperature and material expansion, the phase length will also increase (i.e. an increased number of wavelengths will fit within the increased length of waveguide 11). In order to adjust phase length back to its original value, then, it is necessary to match the increase in length "L" with a decrease in the propagation constant β which can be effected by decreasing the effective large dimension of waveguide 11. As discussed above, a decrease in the effective large dimension of waveguide 11 can be achieved by proper selection and arrangement of the materials of restraining strips 20, long walls 14, and pre-curved walls 16 and 18 (i.e. such that the value δ2 is substantially larger than the value δ1).

Conversely, when the length "L" of waveguide 11 decreases due to reduced temperature and material contraction, the phase length will also decrease (i.e. an reduced number of wavelengths will fit within the decreased length of waveguide 11). In order to adjust phase length back to its original value, then, it is necessary to match the decrease in length "L" with a increase in the propagation constant β which can be effected by increasing the effective large dimension of waveguide 11. As discussed above, a increase in the effective large dimension of waveguide 11 can be achieved by proper selection and arrangement of the materials of restraining strips 20, long walls 14, and pre-curved walls 16 and 18 (i.e. such that the value δ4 is substantially larger than the value δ3).

Accordingly, the arrangement of restraining strips 20 across pre-curved walls 16 and 18 allows the L dimension of waveguide 11 to freely expand or contract according to the waveguide's material properties (i.e. CTE), while simultaneously controlling the effective large dimension of waveguide 11 by appropriately varying the curvature of the pre-curved walls 16 and 18. The overall effect is to maintain the phase length constant (which matters for its electrical performance over temperature changes).

Figure 5:
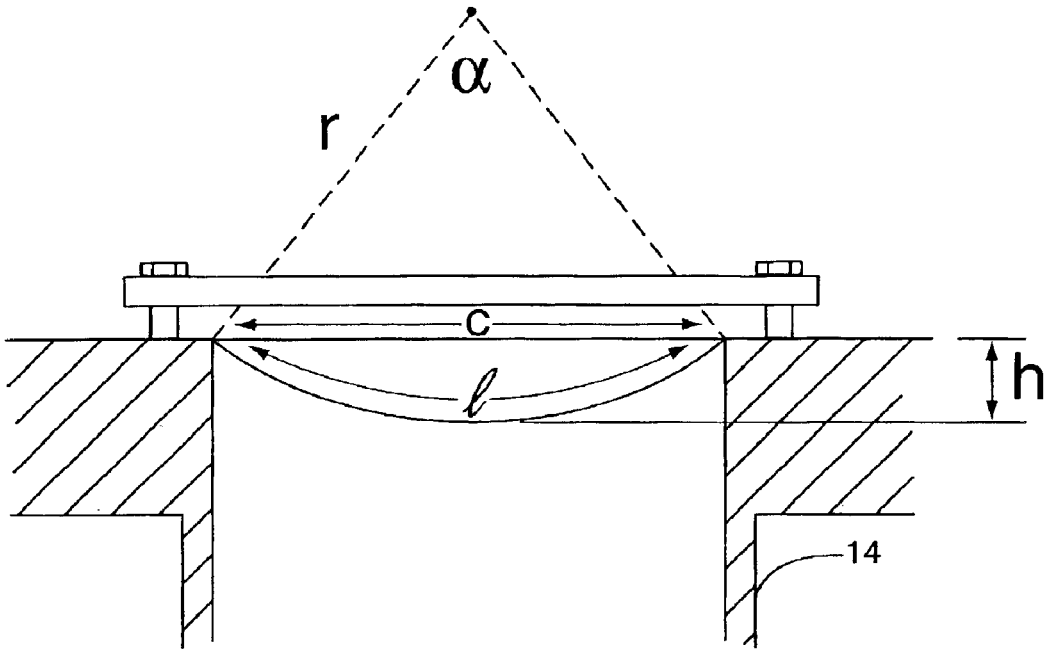
FIG. 5 is a schematic diagram illustrating the geometrical characteristics of the pre-curved narrow walls of FIG. 1.

FIG. 5 illustrates the arc height (h), arc length (l), arc angle (α), arc chord length (c), and circular radius (r) of an equivalent circle that corresponds to the geometry of the circular arc shape of pre-curved narrow walls 16 and 18. For a circular arc segment having arc height (h), arc length (l), arc angle (α), circular radius (r), and circular area (a), the following geometrical relations apply [typical equations are given in Machinery's Handbook 21rst edition, Industrial Press, New York, 1981, page 154 and hereby incorporated by reference]:

$$r = \frac{c^2 + 4h^2}{8h} \qquad l = 0.01745r\alpha \tag{4}$$

$$h = r - \frac{1}{2}\sqrt{4r^2 - c^2}$$

These equations may be used to approximate the cross-sectional geometry of waveguide 11 over temperature changes. The change in curvature height can be calculated from the expansion or contraction of the waveguide narrow wall, dimension (l). This change in the arc length, with a restricted change in dimension (c) due to the restraining strips, results in a change in (h). For example, an aluminum waveguide narrow wall with a nominal dimension of 0.375" and an initial dimension (h) of 0.015–0.020", the change in (l) will result in a change in (h) of 0.002–0.003" over a 100 degree Celsius temperature change. The actual change in (h) will be dependant on relative material thicknesses and stiffnesses, but these simple calculations discussed above provide a starting point.

Figure 6:
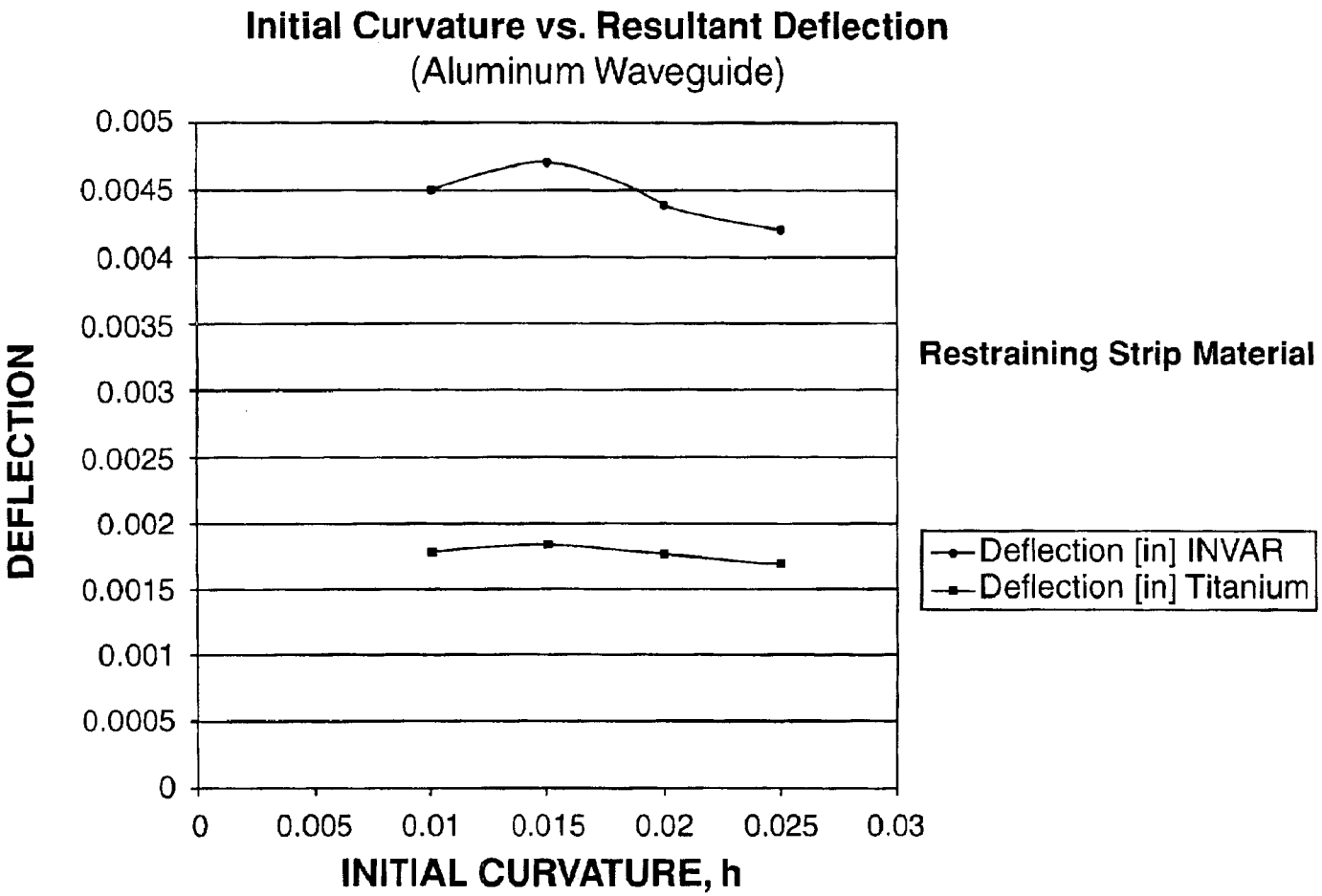
FIG. 6 is a graphical representation of the relationship between initial curvature and resultant deflection when the restraining strips of FIG. 1 are made from INVAR™ and alternately from titanium.

FIG. 6 is graphical representation showing how the initial curvature "h" in inches (i.e. where "D" of FIG. 1 is "h") of pre-curved narrow walls 16 and 18 for a waveguide 11 made out of aluminum relates to the deflection in inches that results after temperature has been increased by 100° C. The two lines show how the differences in material thickness and stiffness for restraining strips 20 made from INVAR™ and titanium result in differences in the initial curvature vs. resultant deflection characteristic. Generally, it can be seen that for INVAR™ restraining strips 20 the top line illustrates how for a particular range of initial curvature there is a greater degree of deflection than is the case for titanium restraining strips 20.

Waveguide assembly 10 can be used within output multiplexers as well as input multiplexers using manifolds and any other application requiring phase-stable waveguides. A multiplexer can be implemented as a series of filters joined by a manifold (short sections of waveguide joined to a common waveguide). The spacing between the filters (measured in guided wavelength) is critical to the performance of the multiplexer. Since the guided wavelength will change with the cross-section of the waveguide (e.g. waveguide 11) over temperature, and the physical spacing between the filters will change with temperature, the conventional approach, as discussed above is to minimize waveguide dimension changes by the use of low expansion materials. This increases stresses in the multiplexer assembly due to CTE mismatch with the structure the multiplexer is mounted on (e.g. spacecraft panel). The ability to compensate the waveguide 11 so that the guided wavelength increases or decreases with the inter-filter spacing of the manifold over temperature is a great benefit in realizing a lightweight, low stress multiplexer assembly.

As will be apparent to those skilled in the art, various modifications and adaptations of the structure described above are possible without departing from the present invention, the scope of which is defined in the appended claims.

What is claimed is:

1. A waveguide assembly for operation over a range of temperatures, said waveguide assembly comprising:

(a) a waveguide body having an effective large dimension and a length, said waveguide body including at least one pre-curved narrow wall made from material having a first coefficient of thermal expansion;

(b) a plurality of restraining strips extending across said pre-curved narrow wall and coupled to the waveguide body on either side of said pre-curved narrow sidewall at first and second lateral points, said restraining strips being spaced from each other and being provided along the length of said waveguide body and being made from a material having a second coefficient of thermal expansion substantially less than the first coefficient of thermal expansion; and (c) said plurality of restraining strips being used to maintain a substantially constant lateral distance between said first and second lateral points over the range of temperatures such that as the length of the waveguide varies with temperature, the degree of curvature of said at least one pre-curved narrow sidewall varies to cause the effective large dimension of the waveguide assembly to change such that the combination of said changes results in a constant phase length for said waveguide body as said waveguide body expands or contracts with temperature.

2. The waveguide assembly of claim 1, wherein the waveguide body includes two pre-curved narrow sidewalls.

3. The waveguide assembly of claim 1, wherein the second coefficient of thermal expansion is less than the first coefficient of thermal expansion by a factor of at least ten.

4. The waveguide assembly of claim 1, wherein the pre-curved narrow sidewall is curved away from the restraining strips.

5. The waveguide assembly of claim 1, wherein the restraining strips are bolted to the waveguide body on either side of the pre-curved narrow sidewall.

6. The waveguide assembly of claim 1, wherein the material comprising the pre-curved narrow sidewall is a material selected from the group consisting of aluminum alloy and magnesium alloy.

7. The waveguide assembly of claim 1, wherein the material comprising the restraining strips is a material selected from the group consisting of iron alloy and nickel alloy.

* * * * *